United States Patent [19]

Jaunin

[11] 4,185,453

[45] Jan. 29, 1980

[54] TIME SETTING AND CORRECTING CIRCUIT FOR ELECTRONIC TIMEPIECES

[75] Inventor: Jean-Pierre Jaunin, Nidau, Switzerland

[73] Assignee: Societe Suisse pour l'Industrie Horlogere Management Services S.A., Switzerland

[21] Appl. No.: 843,003

[22] Filed: Oct. 17, 1977

[30] Foreign Application Priority Data

Oct. 25, 1976 [GB] United Kingdom ..... 44231/76

[51] Int. Cl.[2] ..... G04C 9/00; G04B 27/00

[52] U.S. Cl. ..... 58/35 R; 58/85.5

[58] Field of Search ..... 58/23 R, 23 D, 33, 34, 58/50 R, 85.5

[56] References Cited

U.S. PATENT DOCUMENTS

| | | | |
|---|---|---|---|
| 3,672,155 | 6/1972 | Bergey et al. | 58/50 R |
| 3,852,951 | 12/1974 | Sauthier | 58/23 R |
| 3,889,460 | 6/1975 | Yasukawa et al. | 58/23 R |
| 3,928,959 | 12/1975 | Naito | 58/23 R |
| 3,967,442 | 7/1976 | Berney | 58/23 R |
| 3,988,597 | 10/1976 | Yamaguchi | 58/23 R X |
| 4,030,283 | 6/1977 | Sauthier et al. | 58/23 R |
| 4,044,547 | 8/1977 | Kusumoto | 58/85.5 |
| 4,045,952 | 9/1977 | Kashio | 58/23 R |
| 4,067,187 | 1/1978 | Seriya et al. | 58/23 R |
| 4,072,005 | 2/1978 | Teshima et al. | 58/42.5 |
| 4,083,176 | 4/1978 | Higashi | 58/23 R |

OTHER PUBLICATIONS

France Horlogere, No. 363, May 1976.

*Primary Examiner*—Vit W. Miska

*Attorney, Agent, or Firm*—Griffin, Branigan & Butler

[57] ABSTRACT

A time setting and correction circuit is provided for a quartz time standard timepiece in which the use of memory circuits permits the correction of minute hand setting, hour hand setting and internal putting into phase of seconds through actuation of a single switch.

10 Claims, 3 Drawing Figures

TIME SETTING AND CORRECTING CIRCUIT FOR ELECTRONIC TIMEPIECES

BACKGROUND OF THE INVENTION

The invention hereinafter described concerns an electronic timepiece provided with a circuit directed to time setting and correction. The operating principles of quartz-standard timepieces have now become relatively well known. Generally, a quartz resonator is followed by a frequency divider and this in turn serves to control the operation of either a miniature stepping motor which drives the time indicating hands or alternatively the output of the frequency divider may be applied via a decoder to form numerals on a time indicating surface, such numerals being of either a passive or an active nature. The present invention is more particularly directed to a timepiece of the former variety which is to say the display is formed by time indicating hands moved by a miniature stepping motor.

In most of the quartz timepieces placed on the market up to the present time one of the principal disadvantages resides in the bulk of the instruments. This bulk discourages the development of elegant watch casings and hinders serious use of such timepieces as jewelry. It has, therefore, become desirable to find ways and means of reducing this bulk. Some portions of the internal mechanism and components are only with difficulty reducible, for example a power cell tends to take a comparatively large proportion of the available space. Other components of such timepieces have included the various mechanisms associated with setting the hands and for correcting such setting. Such mechanisms tend to be similar to those associated with classical types of mechanical watches and therefore complex and bulky.

One proposition which provides an improvement to these particular drawbacks is to be found in British Pat. No. 1,405,677. Herein there was suggested that the correcting functions be somewhat simplified by avoiding the use of a seconds hand, driving the minutes hand directly from the stepping motor and arranging for electronic correction of the setting of the minutes hand. A mechanical correction was provided for setting the hours hand or changing the date and thus certain complexities continue to be present. A suitable circuit usable in respect of the arrangement of U.S. Pat. No. 1,405,677 may be found for example in U.S. Pat. No. 1,434,443.

A further advantage drawn from the arrangements found in U.S. Pat. No. 1,405,677 lay in the suggestion that in view of the direct driving of the minutes hand by the stepping motor the stepping could be carried out less frequently than where a seconds hand was employed and this less frequent stepping would lead to a lessening of the power consumption and thereby make possible a smaller battery. The timepiece thus described in these prior patent specifications is now successfully incorporated in commercially available products and in particular has found use in a lady's wrist watch.

Recently, it has become clear that still further improvements in this direction were both possible and desirable. To this effect British Pat. No. 28844/76 describes an arrangement in which there is no seconds hand and no date display. While this may seem to be a strictly negative improvement, nevertheless, it has been found that a very considerable diminution of the overall size is possible, particularly in view of the fact that as described in the above-mentioned application there are no mechanical correcting arrangements whatsoever and all time setting and correcting arrangements are carried out electronically. The correction arrangement insofar as the user is concerned is particularly simple and comprises nothing more than a single pushbutton arranged, for example, to correspond with the normal position of the crown of a mechanical wristwatch. The watch as described in our co-pending application mentioned hereinabove is provided with a stepping motor which is utilized to drive directly the minutes and hour hands through a system of planetary gears. The arrangement is such that the minutes hand is stepped once per minute and this further conserves power as already taught in our prior U.S. Pat. No. 1,405,677 thereby enabling the use of a much smaller battery.

A circuit suitable for providing the necessary time setting and correcting functions is set forth hereinafter. In particular the following features should be available in such a watch:

(a) It should be possible to obtain minutes hand setting.

(b) It should be possible to set the phase of the seconds even though the seconds themselves are not displayed, that is to say that when a time signal is received the minute hand should be just at the point of changing over.

(c) It should be possible to change rapidly the hour hand setting as in the case when the user is travelling between time zones or when there is a change between winter and summer time as is the case in many countries.

SUMMARY OF THE INVENTION

Accordingly, the invention comprises an electronic timepiece including a quartz crystal time standard, multistage frequency dividing means and a stepping motor arranged to be positively coupled to minute and hour indicating hands wherein a time setting and correcting circuit includes a user actuable switch capable of assuming an "on" or an "off" condition, a first a second and a third memory, the first memory being set in response to an actuation of the switch, the second memory being set following a predetermined number of short duration switch actuations within a predetermined time interval, the third memory being set in response to switch actuations of a predetermined longer duration, a first counter and timing means, the arrangement being such that each short duration switch actuation resets all frequency divider stages and in the presence of a predetermined signal from the final frequency divider stage or the set condition of the second memory provides a supplemental motor stepping signal and a switch actuation of said predetermined longer duration as determined by the timing means sets the third memory and enables transmission of supplemental signals at a higher frequency to the motor, the number of said higher frequency signals thus transmitted corresponding to the first counter capacity.

BRIEF DESCRIPTION OF THE DRAWINGS

For a better understanding of the invention refer now to the following detailed description in conjunction with the annexed drawings in which.

DETAILED DESCRIPTION OF THE INVENTION

Figure 1:
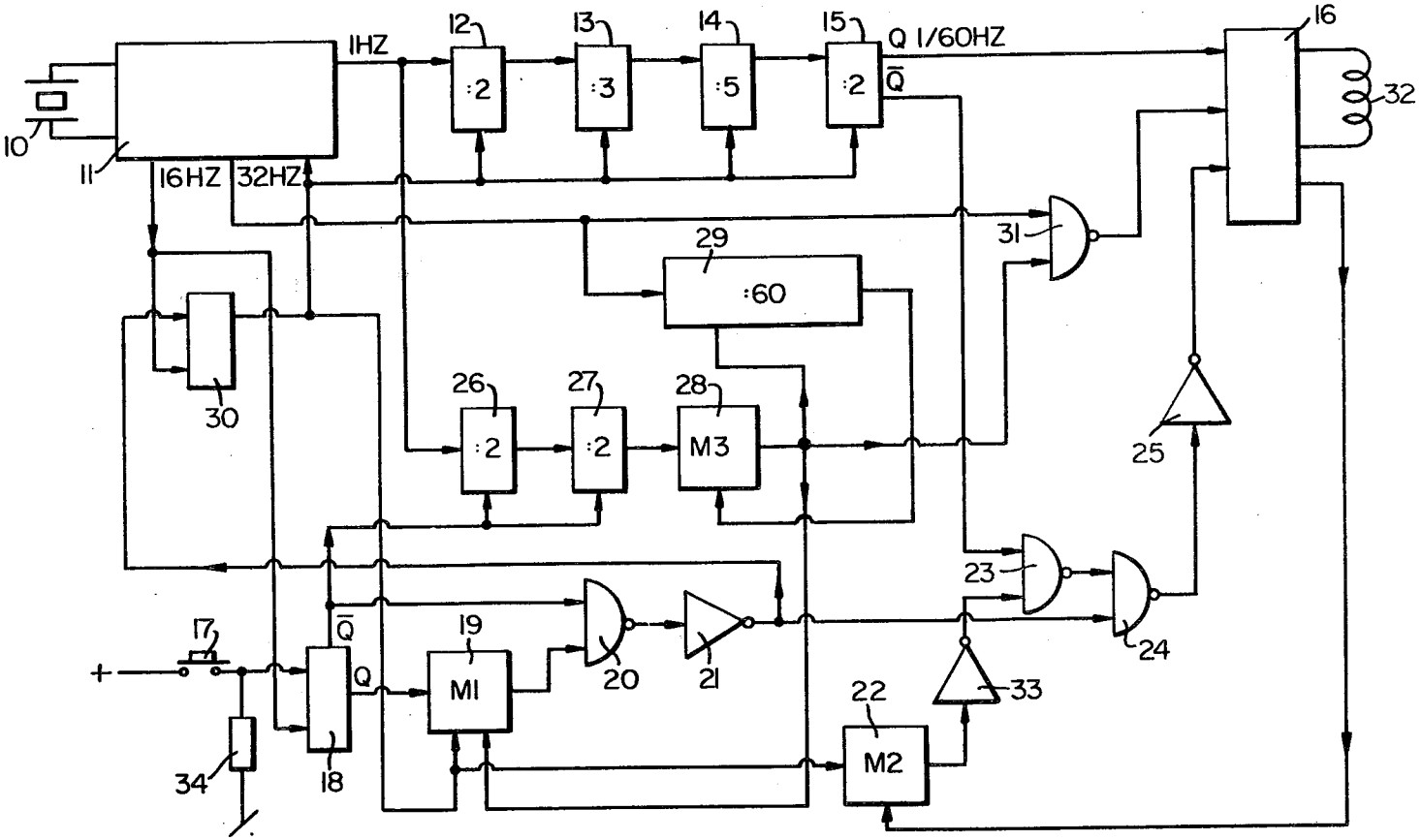
FIG. 1 is a block diagram of the logic circuit of the invention.

All of the elements shown in the drawings in and of themselves are well known in the prior art and it is their particular combination which is of importance in the invention. All of the logic block items are in particular designed to be incorporated into integrated circuits which are essential for wrist watch use in view of their small size.

In FIG. 1 therefore 10 designates a quartz controlled oscillator the output of which is applied to a frequency divider 11. Three outputs are shown from the frequency divider at 16 Hz, 32 Hz and 1 Hz respectively.

Following frequency divider 11, additional stages 12, 13, 14 and 15 are shown by which the frequency is utimately reduced to 1/60 Hz. Signals of this frequency are applied to a motor control and pulse forming block 16 the details of which are not essential to understanding of the present invention. The output from motor control block 16 is fed to the winding of a stepping motor 32 and it will be appreciated that by virtue of the 1/60 Hz input such motor will be stepped once per minute.

As suggested hereinbefore the basic control circuits for correction and time setting provide arrangements whereby the frequency dividers may be brought into phase with a time signal, where the minutes hand may be set by injecting extra pulses into the motor control circuit 16 and finally where a predetermined number of additional pulses at a 32 Hz rate may be applied to motor control circuit 16 in order to effect rapid setting of the hour hand. Each of the foregoing corrections or time setting functions is effected with nothing more than a single control switch 17. As shown the circuit following the control switch 17 comprises various elements, mainly bistable elements plus NAND-gates. Additional counter stages 26 and 27 function as a timing or delay circuit and counter 29 is provided to give a count up to 60. Additionally, memory circuits $M_1$, $M_2$, $M_3$, respectively 19, 22 and 28, are shown for keeping track of the various operations of the switch 17. Finally, elements such as inverters 21, 25 and 33 are provided along with D-type flip-flops such as 18 and 30 the function of which will be apparent from the following description.

Momentary closure of switch 17 causes a voltage pulse to be developed across resistance 34 thereby to set D-type flip-flop 18. The Q signal output is thereafter stored in memory $M_1$ whereas the removal of the $\overline{Q}$ signal serves to remove an inhibit from additional counter stages 26 and 27.

Consider initially the operation of correcting the hour hand setting. Thus, as has been previously seen, depression of switch 17 removes the inhibit signal from counter stages 26 and 27. Accordingly, a 1 Hz signal from the frequency divider 11 is applied to memory $M_3$ following a 4 second delay and stored therein. The signal thereafter obtained from the output of memory $M_3$ is applied to reset memory $M_1$, to trigger counter 29, and as an enable signal to NAND-gate 31.

The enable signal on counter 29 permits it to accept signals from the 32 Hz output of divider 11 and these are counted until the total reaches 60 in accordance with the capacity of the counter. The output from the counter at this point is applied to reset memory $M_3$ unless it should so happen that the switch 17 continues to be held closed in which case a Q disable signal will be applied to counters 26 and 27 whereby memory $M_3$ will be enabled to recycle counter 29 so that another cycle of counting will begin.

The enable signal applied to NAND-gate 31 from memory $M_3$ enables the 32 Hz pulses from frequency divider 11 to be applied to the motor control circuits 16 and hence to the motor winding 32 whereby the motor will be stepped 60 times before memory $M_3$ is cleared and accordingly the minute hand will make one complete revolution returning to the point of departure. Memory $M_1$ having however been cleared there will be no other additional pulses applied to motor control circuits 16.

Consider next the operation of putting the timepiece into phase or synchronism with a time signal corresponding to seconds. For such phase setting again the switch 17 is actuated but in this case once only and for a very short duration. Two situations are recognized. In one of these the timepiece has gained as a result of being worn over a period of time and is now ahead of the correct time by several seconds. In such a case it is desirable that nothing more happen than that the counters forming the divider circuit 11, 12, 13, 14, 15 be reset to zero.

The other possibility occurs where the timepiece is several seconds behind the correct time. In such case it is desirable that the counter stages as hereinbefore mentioned be reset to zero and at the same time a single impulse be added to the minute hand so as to bring it into exact time phase.

In the first of these situations and in view of the particular type of negative edge triggering employed between the divider stages and between the stage 15 and the motor control 16 the Q signal from stage 15 will be zero and the $\overline{Q}$ signal will be one. It is of course to be realized that the signals Q and $\overline{Q}$ obtained from divider stage 15 change only each half minute.

As in the previous case actuating the switch 17 will result in setting D-type flip-flop 18 and applying a Q signal to memory $M_1$. Since the switch 17 is only momentarily actuated flip-flop 18 will likewise provide only a momentary output.

After release of the switch, the output from memory $M_1$ and the $\overline{Q}$ signal once again available from flip-flop 18 are combined in NAND-gate 20 and the output from NAND-gate 20 is applied via an inverter 21 to set D-type flip-flop 30. The output of D-type flip-flop 30 will reset all of the divider stages 11 to 15 inclusive, will clear memory $M_1$ and provide a signal to set memory $M_2$. Flip-flop 30 will itself be cleared by the clearing of memory $M_1$.

The result of the various flip-flops and memories being respectively cleared and set is that the signal applied from inverter 21 to one input of NAND-gate 24 is in the form of a short duration pulse.

In view of the delay imposed by D-type flip-flop 30 the signal obtained from the setting of memory $M_2$ is not available at the exact moment when the pulse appears from inverter 21 and is applied to NAND-gate 24. Accordingly, at this moment the output from memory $M_2$ appears at the input of NAND-gate 23 as a positive input in view of inverter 33 thereby enabling any signal available on the other input of NAND-gate 23 to be transmitted thereby. As previously assumed should the timepiece have been gaining a few seconds then at this point the output $\overline{Q}$ from counter stage 15 will be positive whereby the output of NAND-gate 23 will be zero. Accordingly, NAND-gate 24 is blocked, a 1 is applied to inverter 25 and no signal is applied to the motor control circuits 16. Thus the result of actuating the switch 17 is merely that of clearing all stages of the counter.

Should it now be assumed however that the timepiece had been losing time, much the same sequence of events will follow except that under these circumstances there will be a zero signal on the $\overline{Q}$ output of counter stage 15 whereby NAND-gate 23 is blocked. This being the case there will be an enabling signal applied to NAND-gate 24 and hence a short duration pulse will appear at the output of inverter 25 thereby adding a single pulse to the motor winding 32 via motor control circuit 16. The further output shown from motor control circuit 16 serves to reset memory $M_2$. Such reset of memory $M_2$ is obtained through a motor pulse coming from a "normal" change of state of divider 15.

Consider finally the situation wherein it is desired simply to add a series of pulses to the motor control circuit 16 and thence to the motor 32 in order to advance the minute hand. Herein a series of short duration closures are applied to switch 17. The first of these will as seen in the preceding example result in setting memory $M_2$. Successive pulses thereafter will appear on the output of inverter 21 whereupon they will be applied as a succession of pulses through NAND gate 24, enabled by a "one" output from NAND-gate 23, to inverter 25. A succession of pulses appearing at the output of inverter 25 will as in the previous instance trigger the circuits within motor control arrangements 16 on the negative edge thereof.

Each time a short duration actuation is applied to switch 17, the output of inverter 21 will set flip-flop 30 and therefore will reset all of the divider stages 11 to 15 inclusive, clear $M_1$ and set $M_2$.

Figure 2:
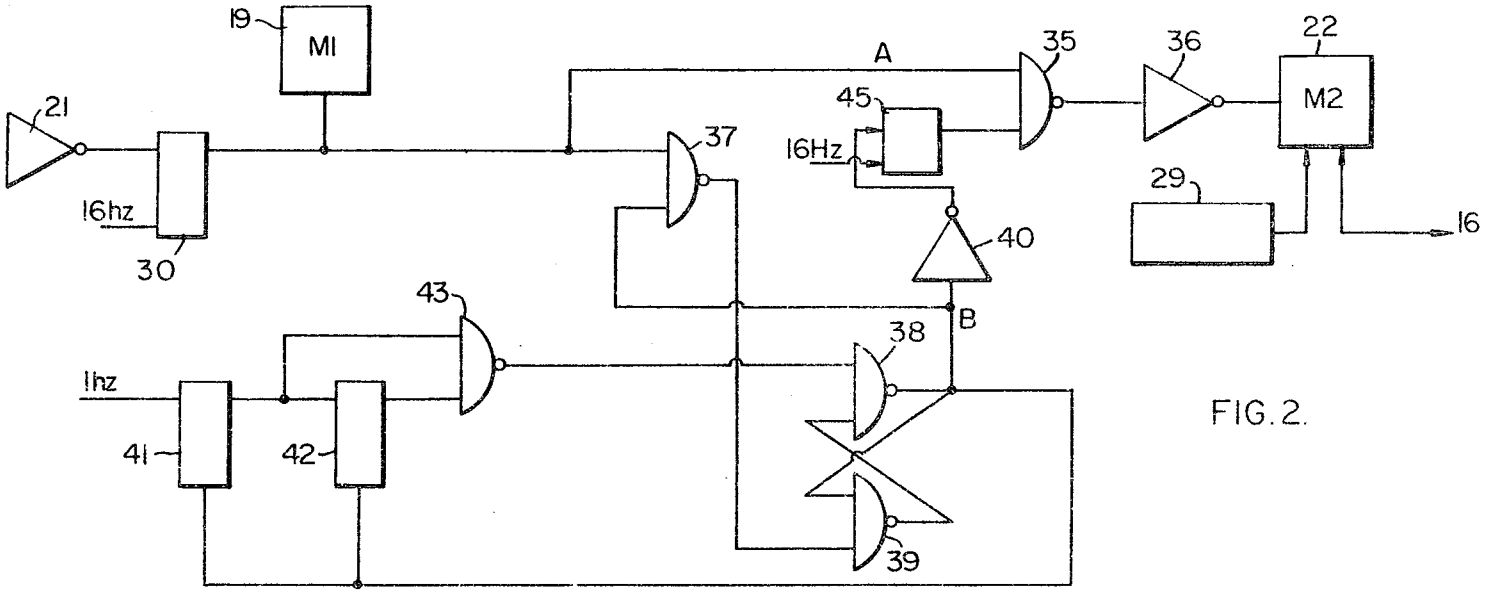
FIG. 2 shows a variant detail.
Figure 2A:
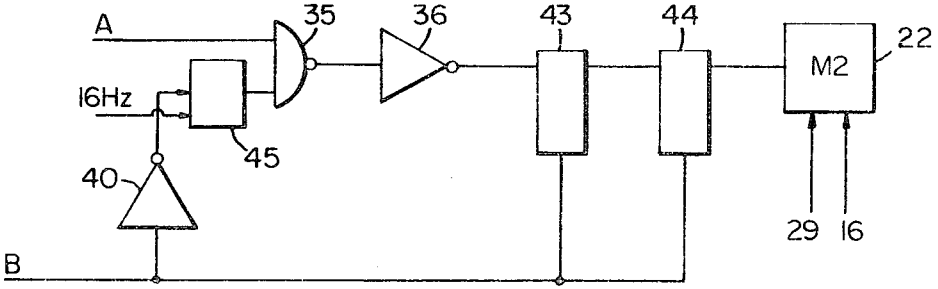
FIG. 2A shows a further detail which can be added to FIG. 2.

Consider now the variant circuits as shown in FIGS. 2 and 2A. In FIG. 2 the arrangement is such that in order to obtain setting of the second memory for the purpose of applying a series of pulses to the motor control circuit, it is necessary to actuate the switch twice within a certain time interval. This interval is determined by counter elements 41 and 42 the outputs of which are combined in NAND-gate 43, and can be varied by employing additional counter and gating elements. When the circuit is not in use a high level output from NAND-gate 38 maintains counter elements 41 and 42 in their reset state.

When a first pulse is received from switch 17 via flip-flop 18, memory $M_1$, inverter 21 and flip-flop 30 (see FIG. 1) this will have no effect since NAND-gate 35 is blocked in view of inverter 40 and timing flip-flop 45 and the high signal from NAND-gate 38. However, this first pulse is transmitted as a low level signal via NAND-gate 37 to NAND-gate 39. The output of NAND-gate 39 accordingly goes high and since NAND-gate 43 is at this instant also providing a high signal the output from NAND-gate 38 goes low thus to provide an enable signal to NAND-gate 35 while removing the reset signal from counter elements 41 and 42.

The counter thus begins to count the 1 Hz signal received at the input of element 41 and at the end of the interval a low level output signal from NAND-gate 43 will restore the elements of FIG. 2 to their quiescent condition as hereinbefore described. During the interval, should a second signal be received from switch 17 it is apparent that this will be transmitted via enabled NAND-gate 35 and inverter 36 to set memory $M_2$.

In FIG. 2A the portion of FIG. 2 shown between A and B is substituted as shown whereby counter elements 43 and 44 are inserted between inverter 36 and memory $M_2$. In this variant it will obviously be necessary to actuate the switch 17 four times within the predetermined time limit before memory $M_2$ is set.

In both FIG. 2 and FIG. 2A memory $M_2$ may be reset either by a normal stepping signal obtained from motor control circuit 16 or by an output signal from the first counter 29. This latter arrangement enables rapid reset of memory $M_2$ through use of the hour hand setting circuit and may be useful to avoid delays during demonstration of the timepiece features since without it a delay of one minute occurs before resetting of $M_2$ from the motor control circuit.

What we claim is:

1. In an electronic timepiece having a quartz crystal time standard, a stepping motor for applying driving motion to coupled minute and hour indicating hands, and multistage frequency dividing means responsive to signals from said time standard for applying stepping signals at a predetermined first frequency to said stepping motor, the improvement comprising a time setting and correcting circuit including:

a single user-actuable switch;

a first memory means;

timing means responsive to said switch for setting said first memory means after actuation of said switch for a predetermined interval of time;

circuit means responsive to said frequency dividing means and said first memory means for applying supplemental stepping signals to said motor at a second frequency higher than said first frequency;

counter means connected to said first memory means and said frequency dividing means for counting said supplemental signals of said second frequency, said counter having an output connected to reset said first memory means when said counter means reaches a predetermined count; and, means responsive to said switch for applying at least one supplemental stepping signal to said motor upon actuation of said switch for less than said predetermined interval of time.

2. The improvement as claimed in claim 1 wherein said counter means comprises a modulo 60 counter.

3. The improvement as claimed in claim 1 wherein said frequency dividing means comprises means for applying stepping signals to said stepping motor at a first predetermined frequency of 1/60 Hz.

4. The improvement as claimed in claim 1 and further comprising means responsive to said first memory means for inhibiting said means for applying at least one supplemental stepping signal to said motor.

5. The improvement as claimed in claim 1 wherein said means for applying at least one supplemental stepping signal to said motor includes a gating means connected to the output of the last stage of said multistage frequency dividing means for inhibiting said single supplemental stepping signal when said last stage indicates the timepiece is a few seconds fast.

6. The improvement as claimed in claim 5 and further including means, responsive to said means for applying at least one supplemental signal, for resetting the stages of said multistage frequency dividing means.

7. The improvement as claimed in claim 1 wherein said means for applying at least one supplemental signal comprises means for applying a single supplemental stepping signal to said motor and includes:

second memory means settable in response to each actuation of said switch;

means responsive to said first memory means, when set, for resetting said second memory means;

third memory means;

first gating means connected to said second memory means and said switch for setting said third memory means; and, second gating means connected to said first gating means and said third memory means for applying said single supplemental stepping signal to said motor.

8. The improvement as claimed in claim 7 wherein said second gating means includes means responsive to said third memory means and said first gating means for generating a single supplemental stepping signal each time said switch is actuated for less than said predetermined interval while said third memory means is set.

9. The improvement as claimed in claim 7 and further comprising means responsive to said first gating means for resetting the stages of said multistage frequency dividing means.

10. The improvement as claimed in claim 9 and further including means connecting the last stage of said multistage frequency dividing means to said second gating means, said second gating means being responsive to said third memory means, when set, and a signal from said last stage indicating that the timepiece is slow, to generate said single supplemental stepping signal.

* * * * *

UNITED STATES PATENT AND TRADEMARK OFFICE

CERTIFICATE OF CORRECTION

PATENT NO. : 4,185,453

DATED : January 29, 1980

INVENTOR(S) : Jean-Pierre Jaunin

It is certified that error appears in the above-identified patent and that said Letters Patent are hereby corrected as shown below:

Column 1, lines 46, 47 and 49, and Col. 2, line 13 for "U.S." read --British--.

Column 1, line 61, for "Pat." read --Application--.

Signed and Sealed this

*Twenty-fourth* Day of *June 1980*

[SEAL]

*Attest:*

SIDNEY A. DIAMOND

*Attesting Officer*

*Commissioner of Patents and Trademarks*